US006085558A

United States Patent [19]

Strathmann

[11] Patent Number: 6,085,558

[45] Date of Patent: Jul. 11, 2000

[54] LOCK-CYLINDER ASSEMBLY FOR MOTOR-VEHICLE DOOR LATCH

[75] Inventor: Michael Strathmann, Velbert, Germany

[73] Assignee: Kiekert AG, Heiligenhaus, Germany

[21] Appl. No.: 09/307,489

[22] Filed: May 10, 1999

[30] Foreign Application Priority Data

May 27, 1998 [DE] Germany ..... 198 23 580

[51] Int. Cl.[7] ..... E05B 17/04

[52] U.S. Cl. ..... 70/153; 70/237; 70/370; 70/379 R; 70/380; 292/107; 292/209

[58] Field of Search ..... 70/150, 153, 237, 70/370, 379 R, 379 A, 380, 372, 451, 479, 484, 485, DIG. 7, DIG. 13, DIG. 40; 292/108, 107, 209

[56] References Cited

U.S. PATENT DOCUMENTS

| | | | |
|---|---|---|---|
| 4,099,397 | 7/1978 | Dauenbaugh | 70/371 |
| 5,070,716 | 12/1991 | Whorlow | 70/380 X |
| 5,697,238 | 12/1997 | Oike | 70/372 X |
| 5,931,035 | 8/1999 | Bolton | 70/370 X |
| 5,987,942 | 11/1999 | Ichinose | 70/370 X |

FOREIGN PATENT DOCUMENTS

| | | |
|---|---|---|
| 0 508 580 | 10/1992 | European Pat. Off. . |
| 43 12 573 | 11/1993 | Germany . |

*Primary Examiner*—Lloyd A. Gall
*Attorney, Agent, or Firm*—Herbert Dubno; Andrew Wilford

[57] ABSTRACT

A motor-vehicle latch assembly has a door latch displaceable between a locked and unlocked position, a housing forming a seat, a lever pivoted on the housing, and a linkage connected between the lever and the door latch for displacement of the latch between its positions by the lever. A lock cylinder can fit in the seat and with the lever and interengaging formations on the lever, housing, and cylinder retain the lever in a predetermined angular position on the housing except when the cylinder is fitted in the seat. The housing is centered on an axis and has an elastically deformable and axially rearwardly projecting tongue having a radially inwardly directed ramp surface. The lever projects radially from the housing and is formed with a radially outwardly open notch receiving the tongue in a predetermined angular position of the lever on the housing. The lock cylinder engages the ramp surface when fitted fully in the seat to deflect the tongue radially outward out of the notch so that until the cylinder is fitted to the seat the lever is prevented from rotating.

9 Claims, 3 Drawing Sheets

LOCK-CYLINDER ASSEMBLY FOR MOTOR-VEHICLE DOOR LATCH

FIELD OF THE INVENTION

The present invention relates to a motor-vehicle door latch. More particularly this invention concerns a lock-cylinder assembly for such a latch.

BACKGROUND OF THE INVENTION

A standard motor-vehicle door latch is carried on the edge of the door and engages around a bolt or pin projecting from a door post in a latched position of the latch. This latch can be actuated by an inside door handle and by an outside door handle from a latched position in which it retains the bolt to an unlatched position freeing the bolt. In addition the latch is typically provided with locking mechanism that uncouples the outside and often also the inside door handles from the latching mechanism so that in a locked position one or both of these handles is ineffective to operate the door.

The locking mechanism is normally controlled in turn by inside and outside locking elements. The inside locking element is typically a button or lever on the inside of the door. The outside locking element is almost always a rotary lock cylinder comprising a cylindrical outer part seated in a cylindrical housing forming part of the latch assembly or door and a rotary barrel or core rotatable in the outer part to pivot a lever connected via a linkage, e.g. a rod or bowden cable, to the locking mechanism of the latch.

In the typical installation as described in European patent application 0,508,580 of Isaacs the inner end of the cylinder core is formed as a noncylindrical shaft rotatable about an axis and fitted to a complementary hole in a short lever extending radially of the axis. The outer end of the lever in connected via the linkage to the lock mechanism.

For ease of assembly the lever is pivoted on the cylinder housing so that the cylinder itself can be installed and withdrawn without having to hold the lever in place. Even with this system it is nonetheless fairly inconvenient to install the lock cylinder since the lever normally extends horizontally in its normal unactuated position. Thus to install the lock cylinder it is necessary to move the lever into the horizontal position, holding it from inside the door, while inserting the cylinder in the door housing from outside the door. At best this operation takes some experience and two hands, at worst it actually requires two installers.

German patent 4,312,573 of Sajfert describes a motor-vehicle door latch which is provided with structure that prevents its parts from moving prior to installation. A holding screw secures the parts relative to each other prior to installation and can be moved out of the way after installation to free them up. While this system does prevent the latch parts from assuming an unwanted position prior to installation, it nonetheless adds a step—manually releasing it—to the assembly process so does not create a net saving of steps or time over the prior-art system.

OBJECT OF THE INVENTION

It is therefore an object of the present invention to provide an improved lock-cylinder assembly for a motor-vehicle door latch.

Another object is the provision of such an improved lock-cylinder assembly for a motor-vehicle door latch which overcomes the above-given disadvantages, that is which allows the lock cylinder to be installed with ease and no extra steps or to manipulation of the latch parts from inside the door.

SUMMARY OF THE INVENTION

A motor-vehicle latch assembly has according to the invention a door latch displaceable between a locked and unlocked position, a housing forming a seat, a lever pivoted on the housing, and a linkage connected between the lever and the door latch for displacement of the latch between its positions by the lever. A lock cylinder can fit in the seat and with the lever and interengaging formations on the lever, housing, and cylinder retain the lever in a predetermined angular position on the housing except when the cylinder is fitted in the seat. More particularly the housing is centered on an axis and has an elastically deformable and axially rearwardly projecting tongue having a radially inwardly directed ramp surface. The lever projects radially from the housing and is formed with a radially outwardly open notch receiving the tongue in a predetermined angular position of the lever on the housing. The lock cylinder it engages the ramp surface when fitted fully in the seat to deflect the tongue radially outward out of the notch so that until the cylinder is fitted to the seat the lever is prevented from rotating.

With this system, therefore, the lever is held in one position until the cylinder is installed. Thus the latch can be completely assembled and the inside of the door can be closed up before the lock cylinders are installed. As these lock cylinders are fitted in place, they automatically couple to the lever and release the retaining unit so that the cylinder can pivot the lever. This greatly eases installation of the lock cylinders and even acts as a modest supplementary theft deterrent as, if the cylinders are pulled, the locking lever is still prevented from rotating freely unless the retaining formations are disengaged from each other.

The lever according to the invention is formed with a pair of radially outwardly projecting tabs forming the tabs and having an angular spacing greater than an angular dimension of the tongue. These tabs have radial heights greater than a radial dimension of the tongue. The housing has a rear end wall formed with an aperture through which the tongue projects and the cylinder has a rotatable core and the lever has an inner end rotationally coupled to the core and an axially offset outer end connected to the linkage.

The housing in accordance with the invention has a rear wall formed with an axially centered hole and the lever has an inner end formed with a collar snap-fitted to the hole. The cylinder having a rotatable core formed with a noncylindrical shaft fitted to the inner end. This collar is formed by a plurality of angularly spaced, radially elastically deflectable, and axially projecting segments. In addition the lever has an outer end formed as an eye and the linkage is a rod hooked in the eye.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
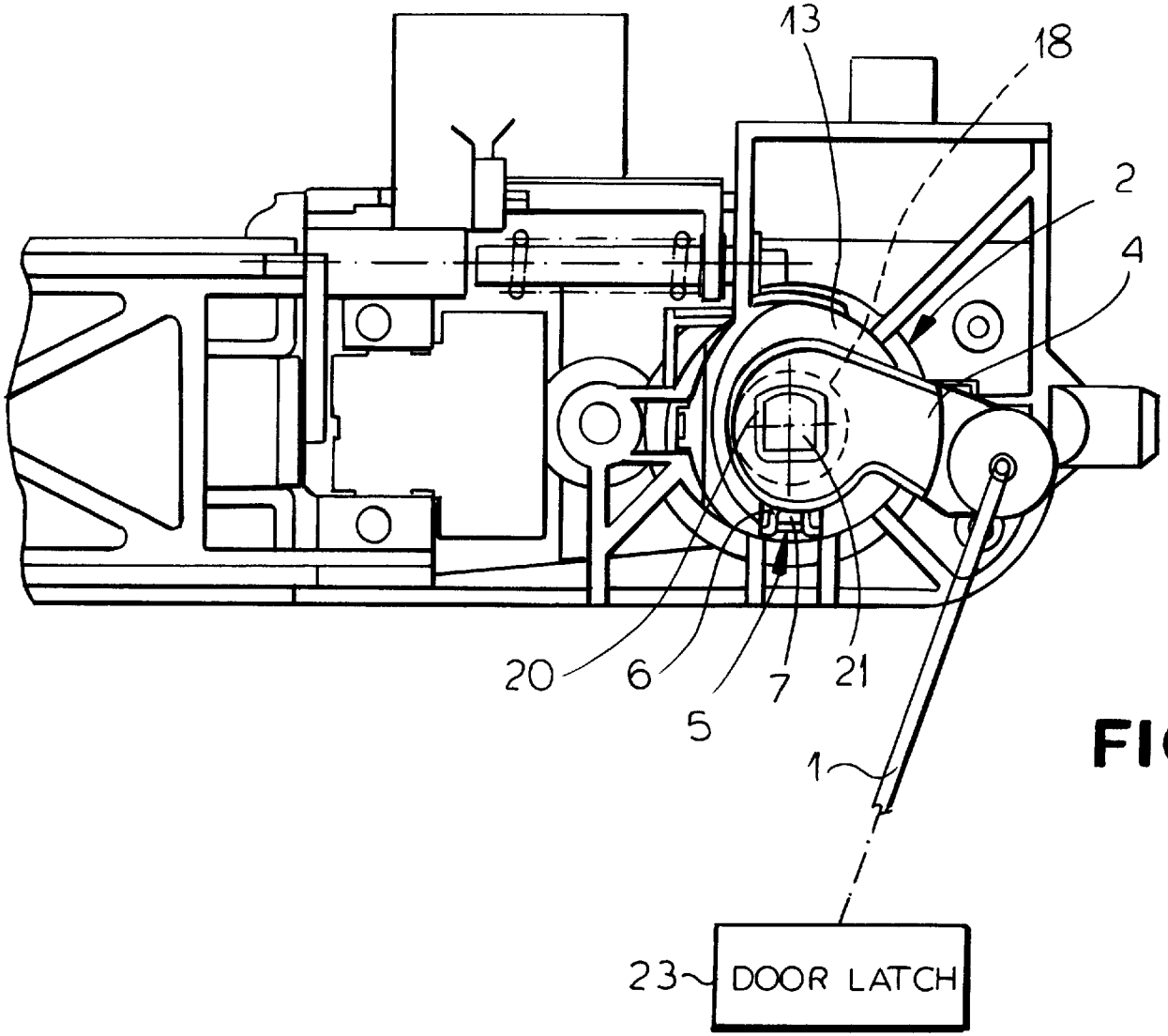
FIG. 1 is a partly diagrammatic rear view of the latch assembly according to the invention.
Figure 2:
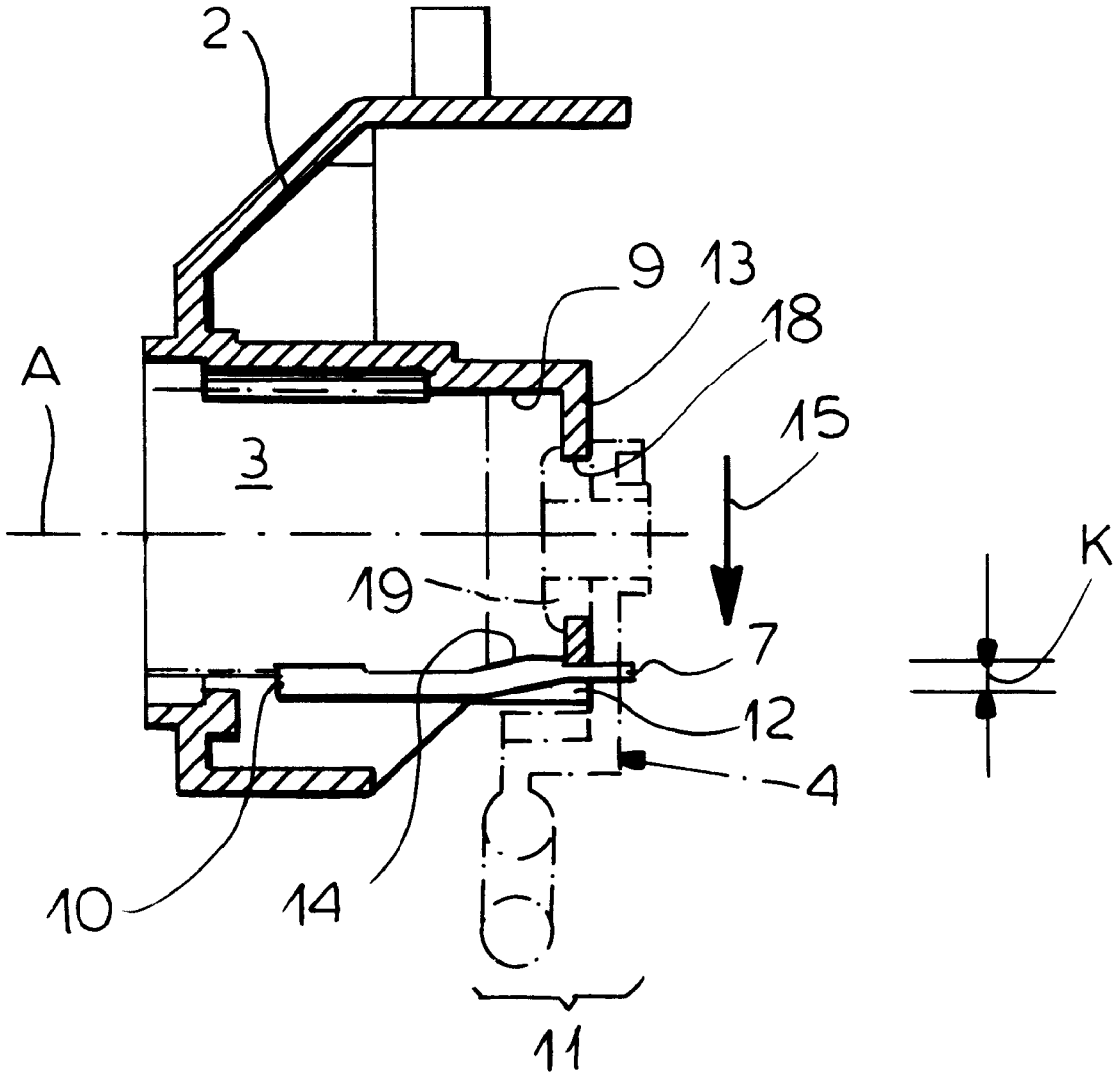
FIG. 2 is an axial section through the lock-cylinder housing of this invention.
Figure 3:
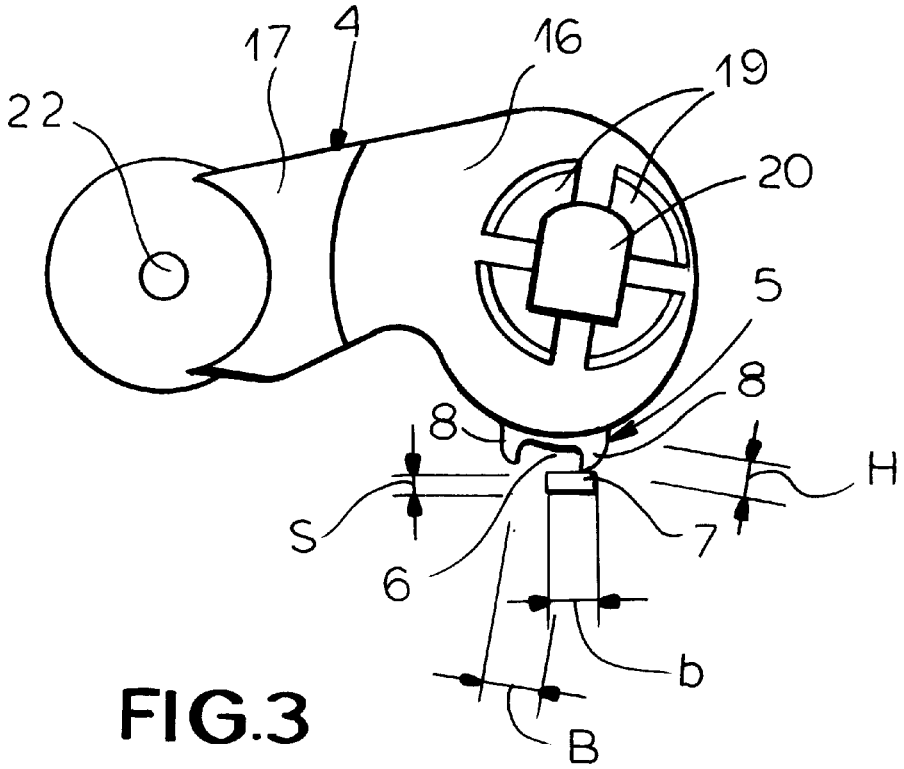
FIG. 3 is a longitudinal section through the actuating lever of the lock assembly.
Figure 4:
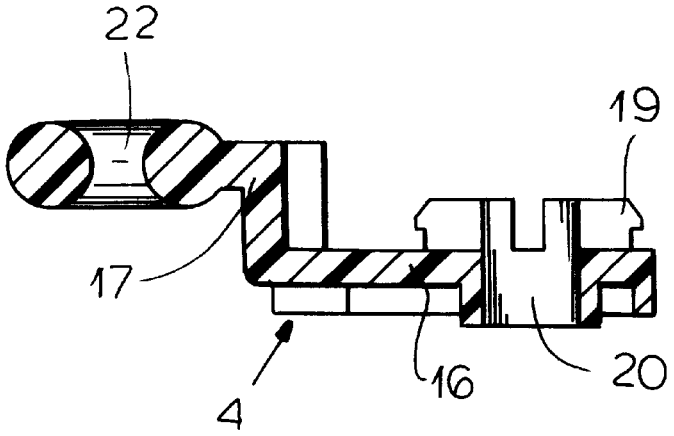
FIG. 4 is an end view of the lever.

As seen in FIGS. 1 and 2, a motor-vehicle door latch 23 of standard construction is displaced between the locked and unlocked position by means of a link rod 1. A cylinder housing 2 holds a standard two-part lock cylinder 3 that can pivot a lever 4 about an axis A to operate this linkage 1.

According to the invention a retainer 5 is provided for holding the lever 4 in the illustrated horizontal position, that is to prevent it from rotating about the axis A. This retainer 5 is constituted as a pair of tabs 8 on the lever 4 defining an outwardly open notch 6 of an angular width B and radial depth H and an axially extending and radially deflectable tongue 7 on the housing 2 having a rear end 11 fittable in the notch 6 and having an angular dimension b and a radial dimension S. Normally the dimension B is equal to one to two times the dimension b and the dimension H is equal to slightly more than the dimension S. The lever 4 is made of a durable plastic like polyoxymethylene or polyformaldehyde and the tongue 7 of spring steel.

The housing 2 forms a basically cylindrical seat 9 centered on the axis A. It has cutouts 10 flanking the tongue 7 and a transverse rear end wall 13 formed with a hole 12 through which projects the rear and 11 of the tongue 7. The tongue 7 itself is formed with an angled ramp surface 14 engageable with the cylindrical outer surface of the cylinder 3 when same is fully inserted into the seat 9 to cam the outer end 11 out as indicated by arrow 15 through a stroke K greater than the notch depth H, thereby freeing the arm or lever 4 for rotation about the axis A.

The lever 4 has an inner and that extends radially from the axis A, an axially extending intermediate portion 17, and an axially forwardly offset and radially extending outer end 22 formed as an eye to which the link 1 is coupled. The rear housing wall 13 is formed centered on the axis A with a circular hole 18 in which engage radially deflectable segments 19 of a collar of the lever 4 so that this lever 4 is actually rotationally mounted on the housing 2. The inner end 16 is further formed with a noncylindrical hole 20 that fits with a complementarily noncylindrical pin 21 projecting from the rear end of the rotatable core of the cylinder 3 so that this lever 4 is rotationally coupled to this cylinder core.

Thus with the system of this invention until the lock cylinder 3 is installed the lever 4 is solidly mounted on the housing 2, but cannot rotate about the axis A. When the cylinder 3 is installed, it cams out the tongue 7 and frees the lever 4 to rotate. If the cylinder 3 is removed, the lever 4, whose rest position corresponds to the position of FIG. 1, similarly is retained in this position.

I claim:

1. A motor-vehicle latch assembly comprising:

a motor-vehicle door latch displaceable between a locked and unlocked position;

a housing forming a seat;

a lever pivoted on the housing;

a linkage connected between the lever and the door latch for displacement of the latch between its positions by the lever;

a lock cylinder fittable in the seat and with the lever; and means including interengaging formations on the lever, housing, and cylinder for retaining the lever in a predetermined angular position on the housing except when the cylinder is fitted in the seat.

2. A motor-vehicle latch assembly comprising:

a motor-vehicle door latch displaceable between a locked and unlocked position;

a housing centered on an axis, forming an axially forwardly open seat, and having an elastically deformable and axially rearwardly projecting tongue having a radially inwardly directed ramp surface;

a lever pivoted on the housing about the axis, projecting radially from the housing, and formed with a radially outwardly open notch receiving the tongue in a predetermined angular position of the lever on the housing;

a linkage connected between the lever and the door latch for displacement of the latch between its positions by the lever;

a lock cylinder fittable in the seat and with the lever and engageable with the ramp surface when fitted fully in the seat to deflect the tongue radially outward out of the notch, whereby until the cylinder is fitted to the seat the lever is prevented from rotating.

3. The motor-vehicle latch assembly defined in claim 2 wherein the lever is formed with a pair of radially outwardly projecting tabs having an angular spacing greater than an angular dimension of the tongue.

4. The motor-vehicle latch assembly defined in claim 3 wherein the tabs have radial heights greater than a radial dimension of the tongue.

5. The motor-vehicle latch assembly defined in claim 2 wherein the housing has a rear end wall formed with an aperture through which the tongue projects.

6. The motor-vehicle latch assembly defined in claim 2 wherein the cylinder has a rotatable core and the lever has an inner and rotationally coupled to the core and an axially offset outer end connected to the linkage.

7. The motor-vehicle latch assembly defined in claim 2 wherein the housing has a r ear wall formed with an axially centered hole and the lever has an inner end formed with a collar snap-fitted to the hole, the cylinder having a rotatable core formed with a noncylindrical shaft fitted to the inner end.

8. The motor-vehicle latch assembly defined in claim 7 wherein the collar is formed by a plurality of angularly spaced, radially elastically deflectable, and axially projecting segments.

9. The motor-vehicle latch assembly defined in claim 2 wherein the lever has an outer end formed as an eye and the linkage is a rod hooked in the eye.

* * * * *